United States Patent [19]

Larsen

[11] 4,170,275

[45] Oct. 9, 1979

[54] EAR CUSHION

[75] Inventor: Paul F. Larsen, Grafton, Wis.

[73] Assignee: Koss Corporation, Milwaukee, Wis.

[21] Appl. No.: 843,745

[22] Filed: Oct. 19, 1977

[51] Int. Cl.[2] ..... H04R 25/00; H04R 1/10

[52] U.S. Cl. ..... 181/129; 179/182 R

[58] Field of Search ..... 181/129; 179/182 R, 179/182 A; 2/209; 128/151

[56] References Cited

U.S. PATENT DOCUMENTS

| | | | |
|---|---|---|---|
| 1,223,545 | 4/1917 | Whitman | 179/182 R |
| 2,468,721 | 4/1949 | Volkmann | 179/182 R |
| 2,570,675 | 10/1951 | Morris | 128/151 |
| 2,621,751 | 12/1952 | Kettler | 181/129 |
| 2,856,469 | 10/1958 | Morse | 181/129 |
| 3,073,410 | 1/1963 | Gongoll et al. | 181/129 |

*Primary Examiner*—Stephen J. Tomsky
*Attorney, Agent, or Firm*—Quarles & Brady

[57] ABSTRACT

A pneumatic ear cushion for a headphone or ear defender is formed from two sheets of vinyl plastic. One sheet is molded to form concentric inner and outer walls about a central opening and a connecting sealing wall which is shaped to form a cavity that receives the user's ear. The second sheet of vinyl plastic forms a back wall to which an adhesive is attached for mounting the cushion to a headphone cup.

11 Claims, 5 Drawing Figures

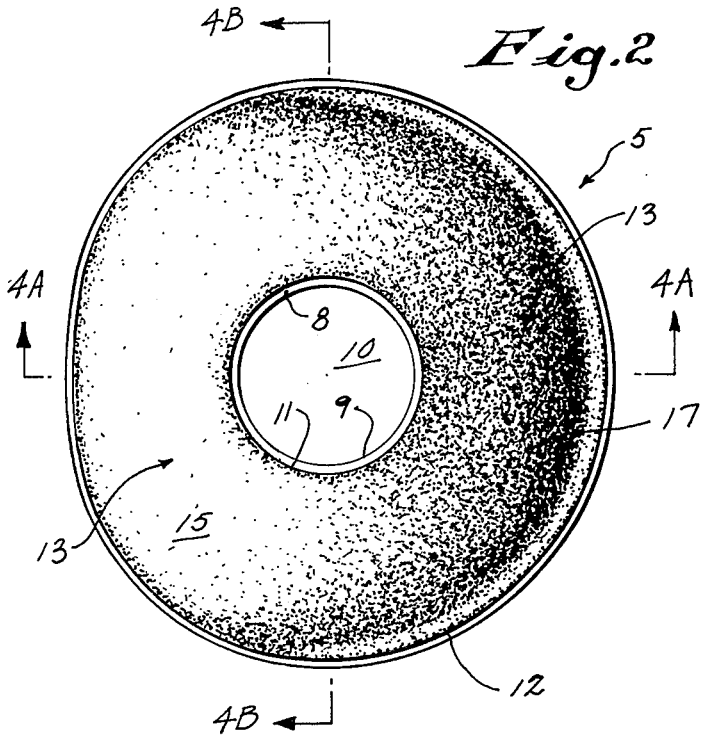
Fig. 2
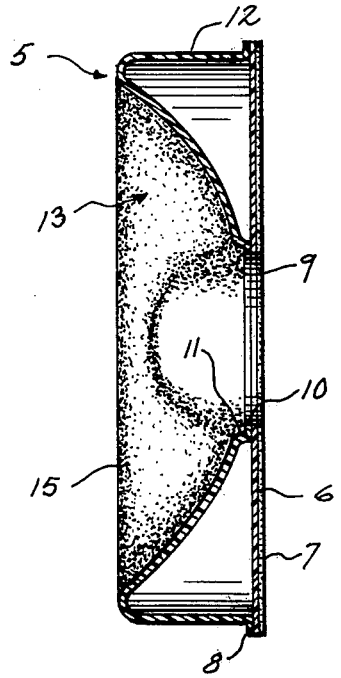
Fig. 4B
Fig. 4A
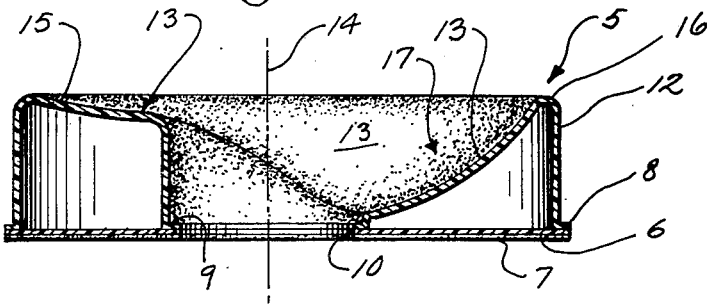
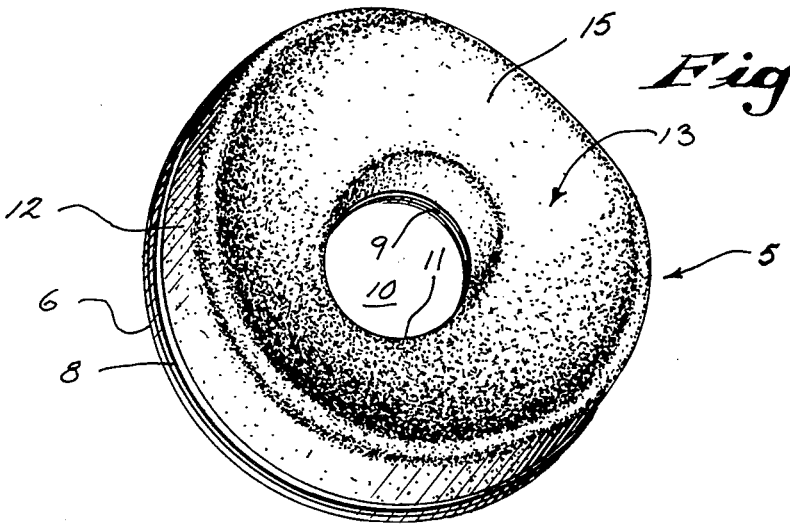
Fig. 3

EAR CUSHION

BACKGROUND OF THE INVENTION

The field of the invention is headphones, and particularly, headphones in which a sealing cushion is provided to exclude external sounds from the ear of the user and/or improve the bass response of the headphone.

Numerous sealing cushions are known in the headphone and ear defender arts for providing a soundproof seal around the user's ears. When employed on an ear defender, a sealing cushion excludes external sounds, whereas when employed on a headphone the major objective is to improve coupling of low frequency sounds between the audio transducers and the user's ears. In either application, user comfort is an overriding factor since headphones and ear defenders may be worn for extended periods of time. Soft and resilient foam rubber and foam plastic cushions have been proposed as disclosed in U.S. Pat. Nos. 1,254,629; 1,514,152 and 3,593,341 and liquid filled cushions have been employed as disclosed in U.S. Pat. No. 2,801,423. Pneumatic cushions have been employed on a number of headphone products of the Koss Corporation in recent years.

Numerous conflicting objectives are imposed on the designer of a sealing cushion. The sealing cushion must be applied with pressure against the user's head in order to conform the sealing surface of the cushion with the contour of the head and yet it is this pressure which has in the past been the major cause of user discomfort. To alleviate this discomfort the sealing cushion can be constructed such that this pressure is not applied to the ear, but instead, to the surface area around the ear. Such "circumaural" sealing cushions are necessarily large and as a result, the headphone cup and supporting structure are also large. Increased size results in added weight which is another source of user discomfort.

SUMMARY OF THE INVENTION

The present invention relates to a sealing cushion for a headphone or the like, and particularly, to a sealing cushion which is shaped to provide an effective seal with a minimal amount of pressure. The sealing cushion is annular in shape and has a central opening defined by an inner wall and a periphery defined by an outer wall, the sealing cushion also has a sealing surface which extends around a sound emitting axis extending through the central opening. The sealing surface connects the inner and outer walls and it slopes inwardly with respect to the sound emitting axis toward the central opening with a pitch that varies around the periphery of the sealing cushion between a minimum along a front portion of the sealing surface and a maximum over substantially the entire sealing surface to the rear of the sound emitting axis. The steep slope of the sealing surface to the rear of the sound emitting axis defines a cavity which receives the ear of a user and the minimal slope over the forward portion of the sealing surface defines a wide forward bearing surface which engages the user's head immediately forward of the ear. A relatively narrow bearing surface is formed around the rear portion of the cushion by the sharply sloped sealing surface.

A general object of the invention is to provide a cushion which seals comfortably against the head of a user. The cavity formed in the sealing surface receives the ear without unduly pressing it against the head or distorting its shape. Also, the area of the head forward of the ear is more sensitive to pressure than the area behind the ear and the wider forwrd bearing surface reduces the pressure per unit area in this forward region.

Another object of the invention is to provide an improved seal for a headphone. The relatively wide forward bearing surface improves the seal in a region through which the bow of eyeglasses pass. On the other hand, the relatively narrow rear bearing surface collapses under pressure to fit more closely the contour of the head, particularly beneath the ear. Also, as the rear bearing surface collapses cushion material expands into the folds of the ear pinna to further improve the seal and reduce the size of the resonant cavity between the diaphragm and ear.

A more particular object of the invention is to provide an improved pneumatic cushion for a headphone. The present invention is particularly effective when embodied as an air filled cushion. The inner wall, outer wall and sealing surface are defined by an airtight material such as vinyl plastic and the cushion is filled with air at substantially atmospheric pressure. With such a structure it has been discovered that the narrow rear bearing surface collapses under slight pressure when applied to the head and the resulting displaced air within the cushion expands, or inflates, the cushion material into the folds of the ear pinna and into the recessed region below the ear and behind the jaw. The displacement of air within the cushion and the resulting "molding" of the sealing surface distributes the headphone pressure evenly on and around the ear to provide a striking increase in user comfort over prior structures. No pressure points are formed which have in past structures caused the user to continuously shift the position of the headphones during extended periods of use.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

BRIEF DESCRIPTION OF THE DRAWINGS

FIG. 2 is a side elevation view of one of the cup assemblies which form part of the headphone of FIG. 1;

FIG. 3 is a perspective view of the cushion which forms part of the cup assembly of FIG. 2; and FIGS. *4a* and *4b* are cross sectional views through the cushion of FIG. 3 taken in the planes indicated in FIG. 2.

DESCRIPTION OF THE PREFERRED EMBODIMENT

Figure 1:
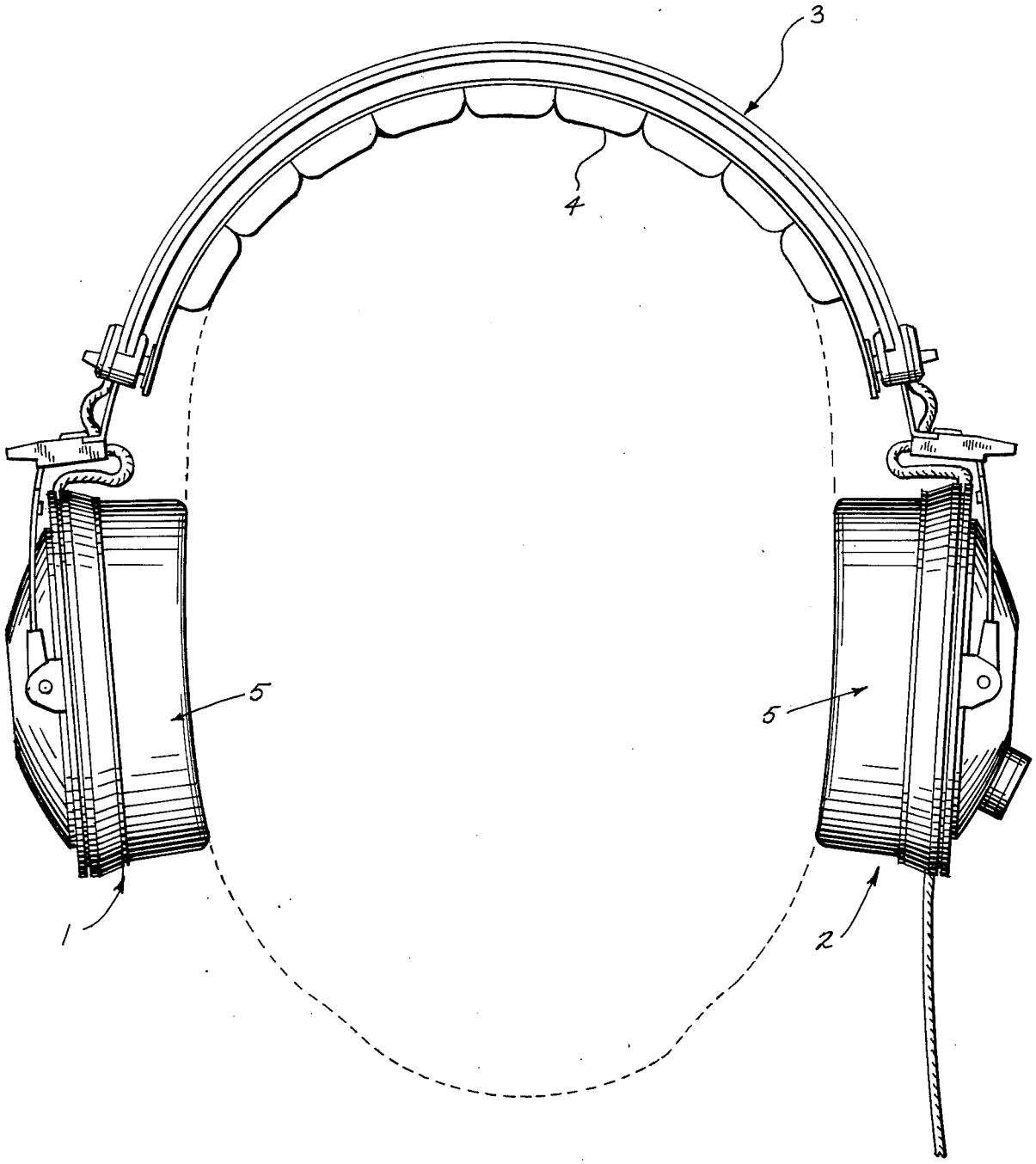
FIG. 1 is a front elevation view of a headphone which employs the cushion of the present invention.

Referring particularly to FIG. 1, a headphone includes a left cup assembly 1 and a right cup assembly 2 which are joined together by a headband 3. The headband 3 extends over the top of the user's head and it is shaped to hold the headphone in place with the cup assemblies pressed lightly against the user's head to establish a seal around each ear. A sling 4 is connected to the underside of the headband at each of its ends and the sling is made of a soft flexible material which conforms to the shape of the head and evenly distributes the weight of the headphone.

Disposed on the inner side of each cup assembly 1 and 2 is a cushion 5. Referring particularly to FIGS. 2–4, each cushion 5 is constructed from two pieces of a heat sealable flexible vinyl plastic material having a thickness of 16 millimeters. Material such as low volatility, low temperature, impact resistant, polyvinyl chloride sold commercially by Pantasote Company of New York, New York, is suitable for this purpose. One sheet of vinyl material is cut to form a substantially circular back wall 6 and an adhesive backing 7 thereon is employed to attach the cushion 5 to the cup assembly 1 or 2.

The second sheet of vinyl material is heated and drawn over a shaped mold to form a contoured surface which engages the user's ear and head. As shown in FIGS. 2–4, this second sheet of vinyl material is heat sealed to the back wall 6 around its outer periphery indicated at 8 and around a circular central portion indicated at 9. The circular central portion is cut away to form a central opening 10 through which sound passes. The resulting cushion 5 is annular in shape having an inner wall 11 which defines the central opening 10 and an outer wall 12 which defines the substantially circular outer periphery of the cushion 5. The walls 11 and 12 are joined together by the back wall 6 and they are joined together along their other edges by a sealing wall, or surface 13 to entrap a volume of air therebetween.

The sealing surface 13 slopes inward toward the central opening 10 with a pitch that varies smoothly about the circumference of the cushion. When measured with respect to a sound emitting axis 14 that extends through the central opening 10 substantially perpendicular to the back wall 6, the pitch of the sealing surface 13 is at a minimum over the forward portion of the cushion 5 and is at a maximum over the rear portion of the cushion 5. The minimal pitch forward of the sound emitting axis 14 forms a relatively wide bearing surface 15 that engages the head of the user forward of his ear, whereas the steep pitch of the sealing surface 13 to the rear of the sound axis 14 forms a relatively narrow bearing surface 16 at the periphery of the rear portion of the cushion 5 which engages the head of the user behind his ear. The steep pitch also carves out a cavity indicated generally at 17 which receives the ear pinna.

The two sheets of vinyl plastic which form each cushion 5 are joined together to entrap a volume of air at atmospheric pressure. When the cushion 5 is applied to the user's ear, a slight sealing pressure is provided by the headband 3 which causes the entrapped air to shift and slightly change the shape of the cushion 5 to fit the contour of the head. The relatively narrow bearing surface 16 to the rear of the ear collapses slightly and the resulting displaced air causes the sealing surface 13 to the rear of the sound axis 14 to rise and bear gently against the ear pinna. As a consequence, the cavity 17 which receives the ear pinna is shaped to the ear to improve the sound seal, to minimize acoustic problems caused by excessive cavity sizes in conventional circumaural cushions, and to distribute the sealing pressure.

The relativey wide bearing surface 15 forward of the sound emitting axis 14 serves to distribute the sealing pressure over a large area immediately forward of the ear. This area is more sensitive to pressure than the area above or to the rear of the ear and the wider bearing surface improves comfort in this region. Also, as shown best in FIG. 4*a*, the substantially square cross sectional shape of the cushion 5 forward of the sound emitting axis 14 does not collapse significantly when pressure is applied to the cushion 5, and it thus serves to maintain proper spacing between the head and headphone cup. Also, the wide surface provided in this region improves the sound seal when the headphone is worn with eyeglasses in place.

I claim:

1. An ear cushion for a headphone or the like which comprises:

a back wall having a central opening through which a sond emitting axis extends;

an inner wall which connects to the back wall, which extends around the central opening and which extends in the direction of the sound emitting axis;

an outer wall which connects to the back wall, which extends around the inner wall and is spaced outward therefrom to define the periphery of the ear cushion, and which extends in the direction of the sound emitting axis; and a sealing wall which connects the inner and outer walls and which presents a sealing surface which slopes inwardly with respect to the sound emitting axis toward the central opening with a pitch that varies around the periphery of the ear cushion between a minimum along a front portion of the sealing surface and a maximum over a substantial portion of the sealing surface to the rear of the sound emitting axis.

2. The ear cushion as recited in claim 1 in which the back wall, inner wall, outer wall and sealing wall are formed from a flexible sheet material and they entrap a volume of air therewithin.

3. The ear cushion as recited in claim 1 in which the steeply pitched sealing surface to the rear of the sound emitting axis defines a cavity for receiving an ear pinna of a user and a relatively narrow bearing surface which engages the head of the user behind the ear.

4. The ear cushion as recited in claim 3 in which the sealing surface forward of the sound emitting axis forms a relatively wide bearing surface which engages the head of the user forward of the ear.

5. The ear cushion as recited in claim 4 in which the back wall, inner wall, outer wall and sealing wall are formed from a flexible sheet material and they entrap a volume of air therewithin.

6. The ear cushion as recited in claim 5 in which the inner wall, outer wall and sealing wall are formed from a single sheet of said flexible material, said back wall is formed from another sheet of said flexible material, and the connection of said back wall to said inner and outer walls is made by heat sealing the two sheets of flexible material together.

7. The ear cushion as recited in claim 6 in which an adhesive is applied to said back wall for fastening the ear cushion to the headphone.

8. The ear cushion as recited in claim 6 in which said flexible sheet material is a vinyl plastic.

9. An ear cushion for a headphone or the like, the combination comprising:

a back wall;

an upstanding inner wall which connects to the back wall and which defines a substantially circular central opening;

an upstanding outer wall which connects to the back wall and which is spaced outwardly from the inner wall and positioned substantially concentric therewith about a sound emitting axis which extends through said central opening; and a sealing wall which connects to one edge of said inner wall and extends radially outward therefrom to connect with one edge of said outer wall, said sealing wall being steeply sloped with respect to said sound emitting axis to form a cavity adjacent to and to the rear of said central opening for receiving an ear pinna of a user and to form a relatively narrow bearing surface radially outward of said cavity for engaging the user's head immediately behind the ear pinna, and said sealing surface has a minimal slope over a portion of its surface forward of said central opening to form a relatively wide bearing surface for engaging the user's head immediately forward of the ear.

10. The ear cushion as recited in claim 9 in which said inner wall, outer wall and sealing wall are formed from a flexible sheet material and they are attached to said back wall to entrap a volume of air therebetween.

11. The ear cushion as recited in claim 10 in which said inner wall, outer wall and sealing wall are formed from a first single sheet of molded vinyl plastic and said back wall is a second sheet of vinyl plastic which is heat sealed to said first sheet.

* * * * *